US005473988A

United States Patent [19]

Dion

[11] Patent Number: 5,473,988

[45] Date of Patent: Dec. 12, 1995

[54] METHOD AND APPARATUS FOR WEDGING SUBMUNITIONS WITHIN AN ENVELOPE OF A PROJECTILE

[75] Inventor: Dominique Dion, Bourges, France

[73] Assignee: Giat Industries, Versailles Cedex, France

[21] Appl. No.: 325,275

[22] PCT Filed: Jan. 28, 1994

[86] PCT No.: PCT/FR94/00104

§ 371 Date: Oct. 24, 1994

§ 102(e) Date: Oct. 24, 1994

[87] PCT Pub. No.: WO94/20817

PCT Pub. Date: Sep. 15, 1994

[30] Foreign Application Priority Data

Mar. 8, 1993 [FR] France ..... 93 02614

[51] Int. Cl.[6] ..... F42B 12/58

[52] U.S. Cl. ..... 102/489; 102/293; 102/393

[58] Field of Search ..... 102/293, 340, 102/342, 351, 357, 393, 476, 489

[56] References Cited

U.S. PATENT DOCUMENTS

| | | | |
|---|---|---|---|
| 2,809,583 | 10/1957 | Ortynsky et al. | 102/393 |
| 3,611,931 | 10/1971 | Bessey et al. . | |
| 4,480,552 | 11/1984 | Eckel et al. | 102/393 |
| 4,793,260 | 12/1988 | Kruse et al. . | |

FOREIGN PATENT DOCUMENTS

| | | | |
|---|---|---|---|
| 144293 | 6/1985 | European Pat. Off. | 102/489 |
| 3732752 | 4/1989 | Germany . | |
| 3732744 | 4/1989 | Germany . | |
| 3602947 | 6/1990 | Germany | 102/393 |
| 3925390 | 2/1991 | Germany | 102/489 |

*Primary Examiner*—Harold J. Tudor
*Attorney, Agent, or Firm*—Oliff & Berridge

[57] ABSTRACT

A wedging device includes bars evenly distributed at an angle. Each bar has a bearing surface designed to come into contact with an internal surface of the envelope and two holding surfaces designed to come into contact with at least two adjacent sub-munitions. Each bar is divided into at least two half-bars that contact one another by at least one slanted guiding surface. By relative sliding of each half-bar, the two holding surfaces forced apart in such a way as to eliminate any radial give in the sub-munition assembly within the envelope.

8 Claims, 8 Drawing Sheets

METHOD AND APPARATUS FOR WEDGING SUBMUNITIONS WITHIN AN ENVELOPE OF A PROJECTILE

BACKGROUND OF THE INVENTION

The scope of the present invention is that of wedging devices for sub-munitions placed inside the envelope of a projectile.

It is known to design projectiles intended to carry sub-munitions. These projectiles can be of a type such as the artillery shell, missile, rocket or mortar projectile.

Such a projectile comprises a pyrotechnic charge which is initiated when it nears its target thereby causing the sub-munitions to be ejected from the envelope.

The sub-munitions can be of the anti-personnel or anti-tank type. When their diameter is less than that of the internal diameter of the envelope, the problem arises of how to wedge them radially with respect to the envelope.

In fact the projectile must be able to withstand the mechanical stresses caused by the transportation, handling and above all firing, without causing the deterioration of the sub-munitions.

U.S. Pat. No. 4,793,260 describes an artillery shell which carries anti-tank bomblets. The latter are wedged with respect to the envelope by means of inserts. Each insert comprises concave surfaces which come into contact with two adjacent bomblets and also comprises one convex surface which comes into contact with the internal surface of the shell envelope.

Thus, six inserts evenly distributed at an angle provide the radial wedging for seven bomblets with respect to the shell envelope.

The shell contains several "layers" of bomblets stacked axially, and each layer is wedged with respect to the envelope by a set of six inserts.

Such a wedging device presents certain disadvantages.

In fact, in order to ensure that the bomblets remain immobile, the inserts have to be of such a size that the assembly presents no radial give.

Such a tightly fitting assembly imposes the use of a press to install into the shell each group of seven bomblets together with their inserts.

So as to limit the compressive load and the stresses to which the bomblets are subjected, it is not possible to install all the "layers" of bomblets in a single operation.

The assembly must therefore be carried out "layer" by "layer", resorting at each stage to the use of a press to install the inserts.

Such an installation procedure is both long and costly. In fact, a bomblet-carrying artillery cargo shell can hold up to nine layers of bomblets which implies nine successive compression operations.

SUMMARY OF THE INVENTION

A goal of the present invention is to propose a wedging device for sub-munitions which enables the sub-munitions to be quickly installed into the envelope and whereby the sub-munitions are radially wedged with no give in respect of the envelope.

Therefore, an object of the invention is a wedging device for sub-munitions placed inside a projectile envelope, a device constituted of small bars evenly distributed at an angle, each bar comprising a bearing surface designed to come into contact with an internal surface of the envelope and two holding surfaces designed to come into contact with at least two adjacent sub-munitions, this device being characterised in that each bar is divided into at least two half-bars which come into contact with each other by at least one inclined guiding surface, a surface such that, by the relative sliding of each half-bar, it enables the two holding surfaces to be forced apart in such a way as to eliminate radial give in the sub-munitions assembly in the envelope.

According to one particular embodiment of the invention, each half-bar is constituted by the assemblage of at least two identical block elements, each block element comprising a bearing surface, a holding surface and a guiding surface.

Advantageously, the block elements constituting a half-bar are assembled by means of dog points and holes fitted to each end.

The block elements can be identical for both half-bars.

So as to facilitate the assembly of the bars, each block can be fitted with a pin placed on its guiding surface. This pin is designed to fit into a housing cut into the guiding surface of another block, the pins and housings enabling the two half-bars to be assembled in a relative position such as to leave a minimal distance between the holding surfaces of the bar thereby constituted.

The bars will preferably be made of a plastic material.

BRIEF DESCRIPTION OF THE DRAWINGS

The invention will be better understood after reading the following description of the different embodiments of the invention, a description made with reference to the diagrams given in annex and in which:

In FIG. 5*b* it is represented in its wedging position, a position wherein it is of a maximum width thus eliminating any give in the sub-munition assembly;

In FIG. 6*a* the bars have only just been installed, and in FIG. 6*b* they have widened to eliminate give in the assembly.

DETAILED DESCRIPTION OF PREFERRED EMBODIMENTS

Figure 1:
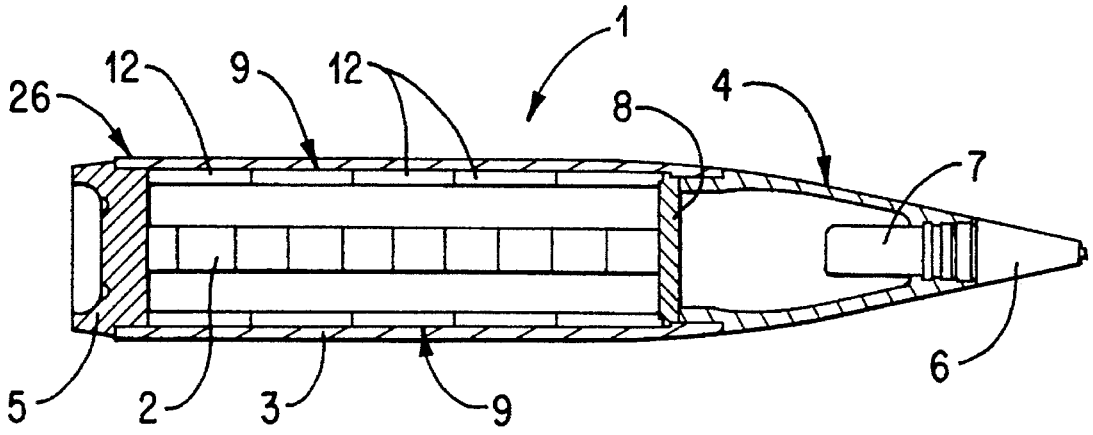
FIG. 1 represents an axial cross-section of an artillery cargo shell carrying sub-munitions of the antitank type, a shell fitted with a wedging device according to the invention.
Figure 2:
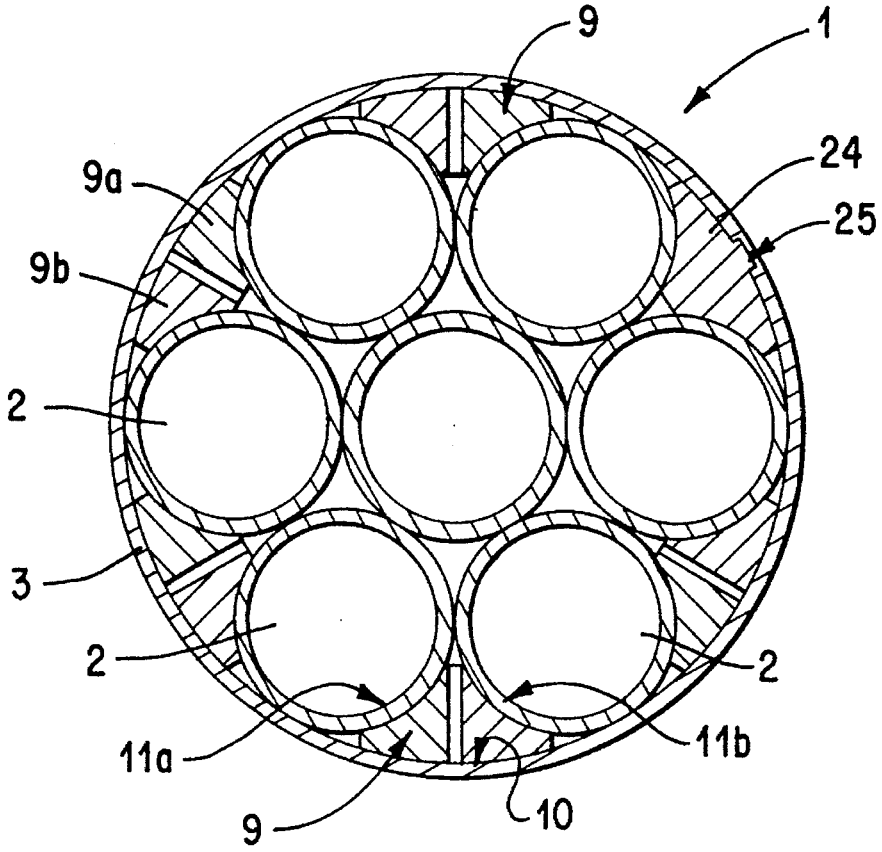
FIG. 2 is a lateral cross-section of this shell.

If we refer to FIGS. 1 and 2, a cargo shell 1 carries sub-munitions of the anti-tank "bomblet" type 2 installed inside an envelope 3.

The envelope 3 is closed at one end by an ogive nose 4 and at the other by a base 5. A fuse 6, of the timer type, is designed to initiate a gas-generating pyrotechnic charge 7.

The charge 7 is separated from the bomblets 2 by a piston 8.

The envelope 3 is fitted with a belt 26 at its rear which enables it to mesh with the rifling when fired from a gun barrel (not represented).

In a known way, at a given moment in the shell's trajectory, this being determined by the fuse 6 programmed before firing, the gas-generating charge 7 is initiated.

The gases which are generated exercise pressure on the piston 8 thereby causing the base 5 to separate from the envelope 3 and the bomblets 2 to be ejected from the envelope.

In the example as represented herein, the shell carries nine rows of seven bomblets. In a known way, the bomblets nest into one another by means of their shaped charge casings (not represented).

They are evenly distributed at an angle and are held in position relative to the envelope 3 by means of a wedging device.

The wedging device according to the invention is constituted of five bars 9 evenly distributed at an angle. Each bar 9 comprises a bearing surface 10 designed to come into contact with an internal surface of the envelope 3.

It also comprises two holding surfaces 11 (11*a* and 11*b* respectively) which are in contact with two adjacent bomblets 2.

The bars extend over roughly the whole of the loading depth of the bomblets, in other words from the base 5 to the piston 8.

A longitudinal metallic wedge 24 completes the bars and enables the bomblets to be drawn together into a rotational movement by the envelope 3.

This wedge extends over roughly the whole of the loading depth of the bomblets, in other words from the base 5 to the piston 8. Its external profile is similar to that of one of the bars and it also comprises a bearing surface in contact with the envelope 3 and holding surfaces in contact with adjacent bomblets.

The wedge comprises a peg 25 which comes to rest in a groove cut into the envelope thereby enabling the bomblets to be drawn into a rotational movement.

Each bar is divided into at least two half-bars 9*a*, 9*b* which present specific contact surfaces as will be described hereafter.

Each half-bar is constituted of the longitudinal assemblage of block elements 12 which are all identical. Each block 12 herein is roughly as long as two bomblets.

The constitution of bars by means of block elements enables bars of different lengths to be composed from the same blocks thereby enabling the bars to be adapted to projectiles carrying different quantities of bomblets.

Figure 3A:
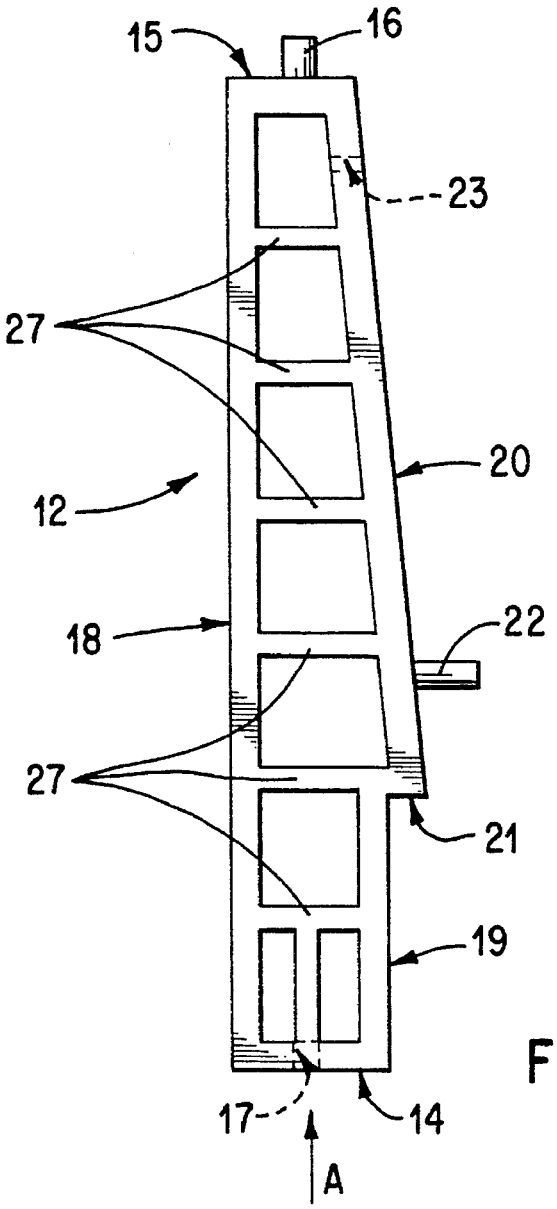
FIGS. 3*a* and 3*b* are two views of one of the block elements used to constitute a wedging bar according to the invention, FIG. 3*b* being a view of FIG. 3*a* following the plane A.
Figure 3B:
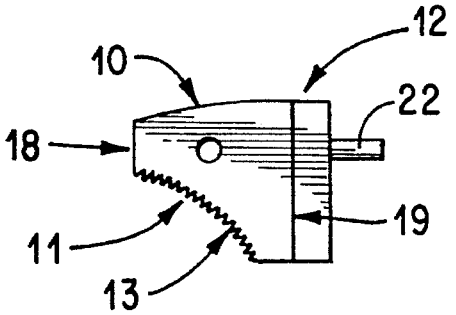

FIGS. 3*a* and 3*b* represent two mutually perpendicular views of a block element 12.

This block comprises a slightly convex profile wherein the radius is equal to that of the internal radius of the envelope 3. This profile is marked out in 10, the juxtaposition of the convex profiles of the different blocks constitutes the bearing surface 10 of the bar.

It also comprises a concave profile of which the radius is equal to that of a bomblet. This profile is marked out in 11, the juxtaposition of the concave profiles of the different blocks constitutes one of the holding surfaces 11 of the bar.

The holding surface 11 is fitted with V-shaped longitudinal grooves 13 which extend over the full length of the block 12. These grooves are designed to deform when the bomblets are being wedged, thereby ensuring that the bomblets are securely wedged whatever their exact size so long as they remain within the range of dimensional tolerance.

The block 12 also comprises ends 14 and 15 by which it is fitted to other blocks in order to constitute a half-bar.

So as to assemble the blocks, the end 15 is fitted with a dog point 16 and the end 14 is fitted with a hole 17. The dog point 16 is designed to fit into a hole 17 on a second block, the hole 17 is designed to house a dog point 16 of a third block.

The block 12 comprises two side faces 18 and 19, parallel to each other and roughly perpendicular to the ends 14 and 15.

The block 12 lastly comprises a guiding surface 20 which slants in relation to the axis of the concave surface 11. This slanting surface extends from the end 15 up to a side extrusion 21. The slanting surface 20 is fitted with a pin 22 and a housing 23, these two elements are designed, as will be described hereafter, to enable two bars to be temporarily fitted together.

The block 12 is made of plastic material, for example of the Polyamide 6 type or polyamide 6-6 (products distributed under the trade name "Nylon"). The constituent material of the bars will make it easier for the blocks to slide along their guiding surfaces 20.

All the forms, notably the dog point 16, the pin 22, the hole 17 and the housing 23 are obtained during the injection-blow molding of this material.

So as to facilitate the injection-blow molding operations and to ensure good mechanical resistance, each block has roughly the same thickness of material over its whole geometry and comprises cross struts 27 to ensure its rigidity.

Figure 4A:
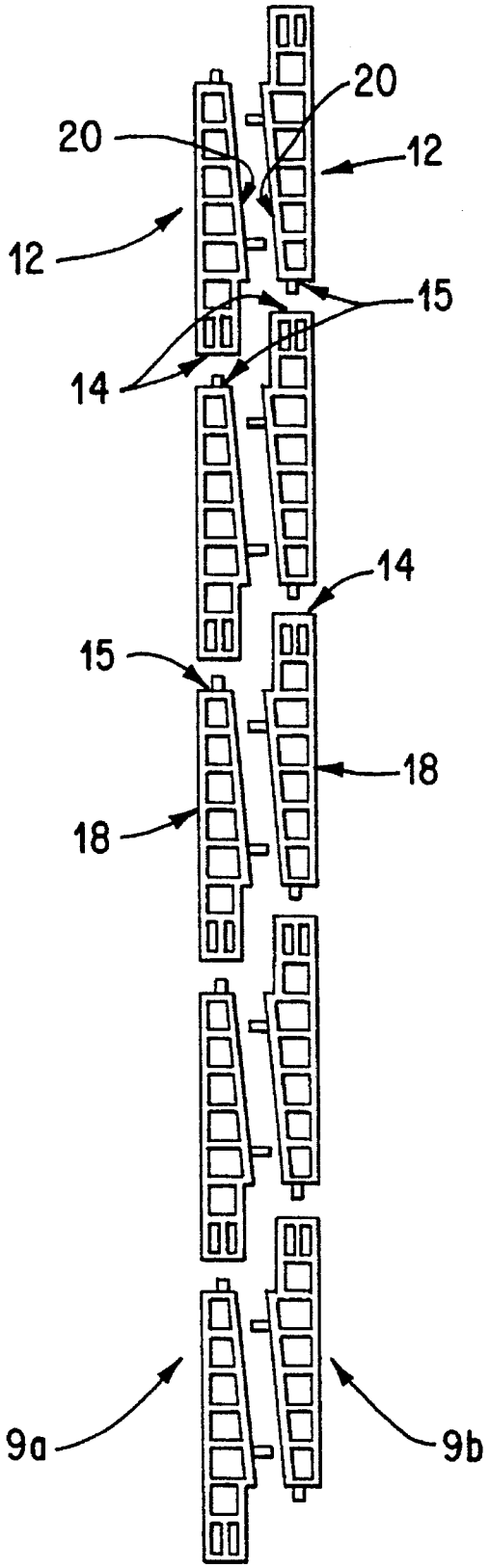
FIGS. 4*a* and 4*b* show how the different block elements are positioned in order to constitute a bar.
Figure 4B:
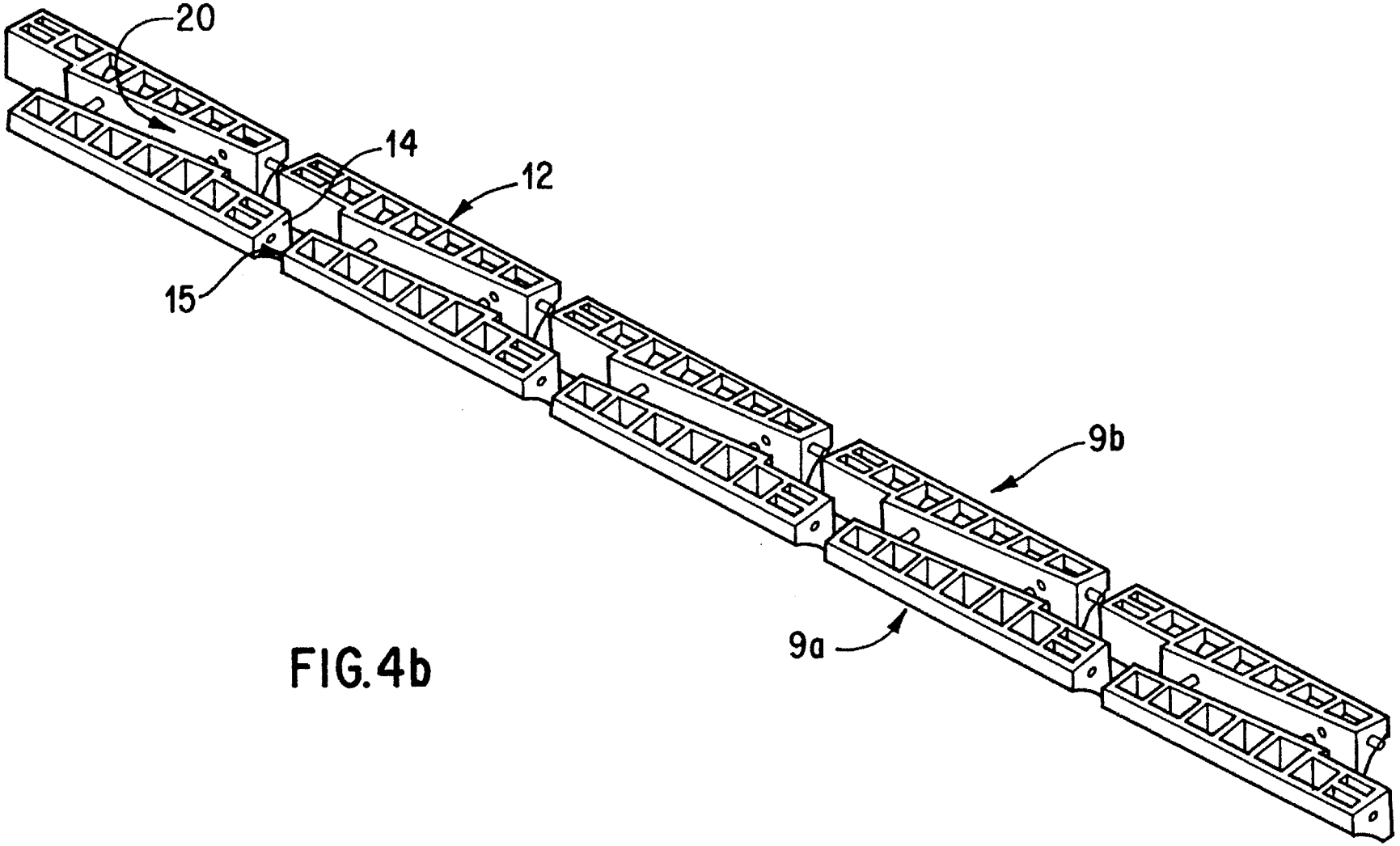

FIGS. 4*a* and 4*b* show ten blocks 12 which are laid out in such a way as to enable them to be assembled to constitute a full bar.

Five blocks 12 are fitted together end-to-end (14–15) so as to form a half-bar 9*a*, five other blocks will be fitted together in the same way so as to form a half-bar 9*b*.

The two half-bars 9*a* and 9*b* will thereafter be positioned next to one another with their respective slanted surfaces 20 opposite each other.

Each half-bar is assembled by means of the dog points 16 and the holes 17.

Two half-bars are fitted together by means of the pins 22 and the housings 23.

The side extrusions 21 on each block 12 act as a stop surface for the ends 14 of the different blocks, the side surfaces 19 of the blocks in each half-bar thereby come into contact with each other.

Figure 5A:
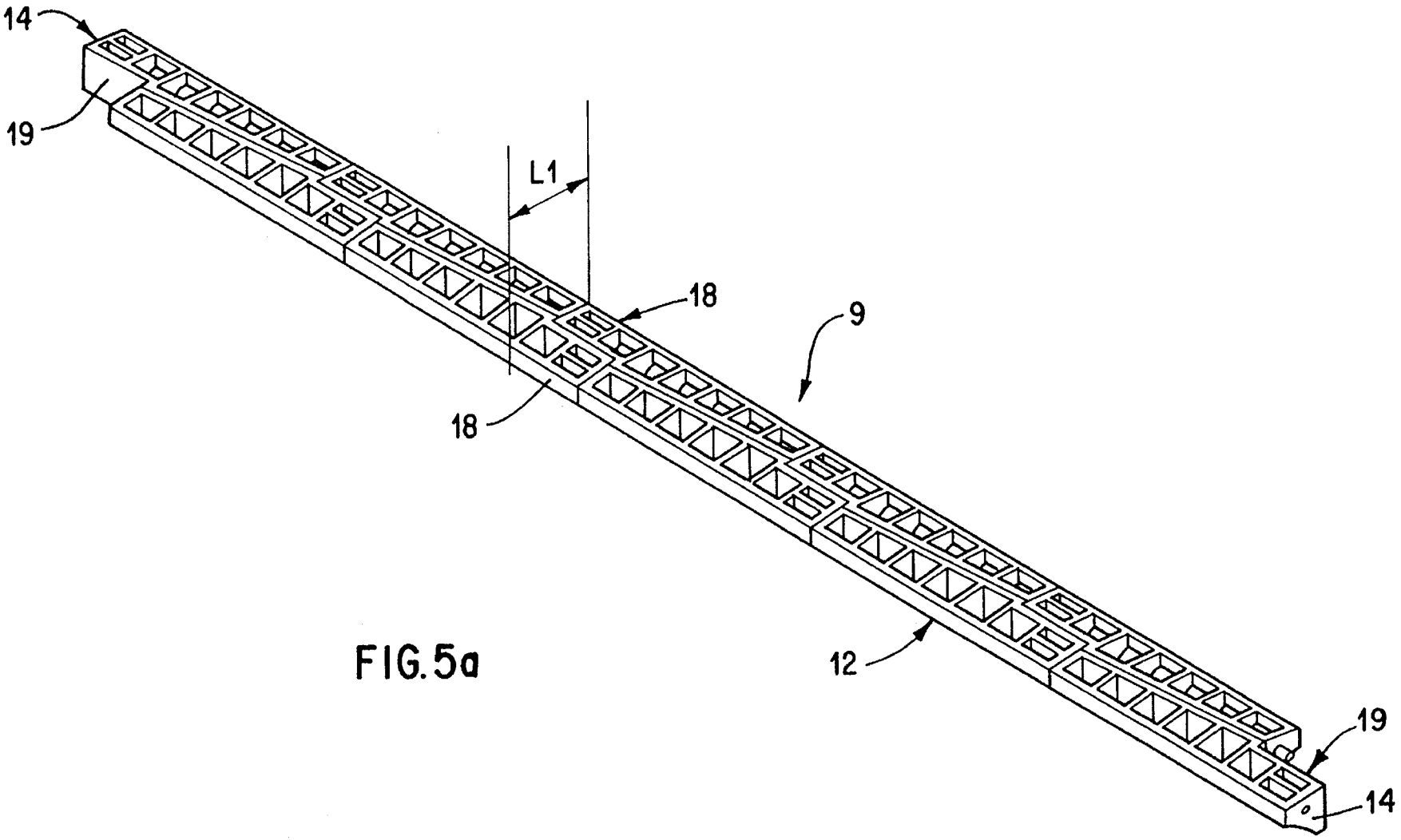
FIGS. 5*a* and 5*b* show a bar assembly. It is represented in FIG. 5*a* in its original position, a position wherein it is of a minimum width thus enabling it to be installed in the shell.

The bar 9 thereby obtained is represented in FIG. 5*a*.

Because of the particular geometry of the blocks 12, the assembled bar presents an axial shift compared with the half-bars 9*a* and 9*b*, the length of this shift being equal to that of the side surface 19.

The width of the bar 9 is represented in L1 and is equal to double that of the distance which separates the side surfaces 18 and 19 of each block.

This configuration of the bar 9 is that said to be its "initial position", a state in which it presents a minimum width thereby enabling it to be placed in the shell.

An axial strain placed on the ends 14 of the bar 9 causes the pins 22 to be sheared and allows relative axial sliding of the two half-bars.

The guiding surface slant 20 forces the side surfaces 18 and the holding surfaces 11 apart from one another.

Figure 5B:
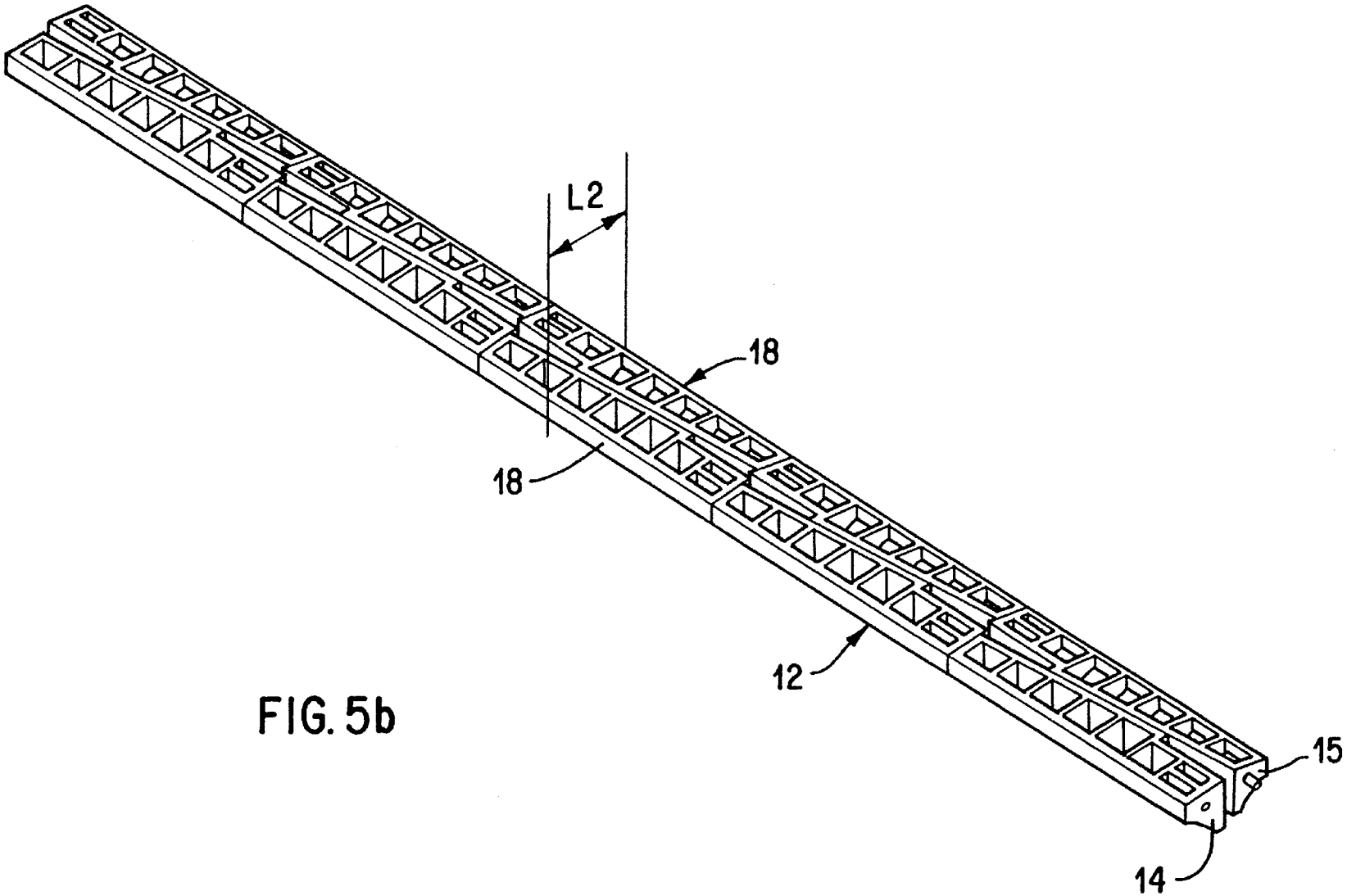

When two half-bars are made to slide until they are on a level with each other, we obtain the bar configuration 9 represented in FIG. 5*b*.

This configuration of the bar 9 is that said to be its "wedging position", a state in which it presents its maximum width thereby enabling it to eliminate radial give in the bomblet assembly.

The width of the bar 9 is presented in L2 and it is greater by a few millimeters than the initial value L1. The value L2 depends on the slant of the guiding surface 20, this slant may be given a value such that the radial give of the bomblet assembly may be eliminated.

The wedging device according to the invention enables the installation of bomblets inside a shell to be considerably simplified.

It is thereby possible to install all the bomblets and the wedging bars (in their "initial position") in a single operation.

It is also possible to insert the wedging bars after the bomblets have been installed. In fact the reduced width of the bars enables them to be slipped in between the bomblets with no difficulty. The rigidity of the block assembly constituting the bar also facilitates their insertion.

Figure 6A:
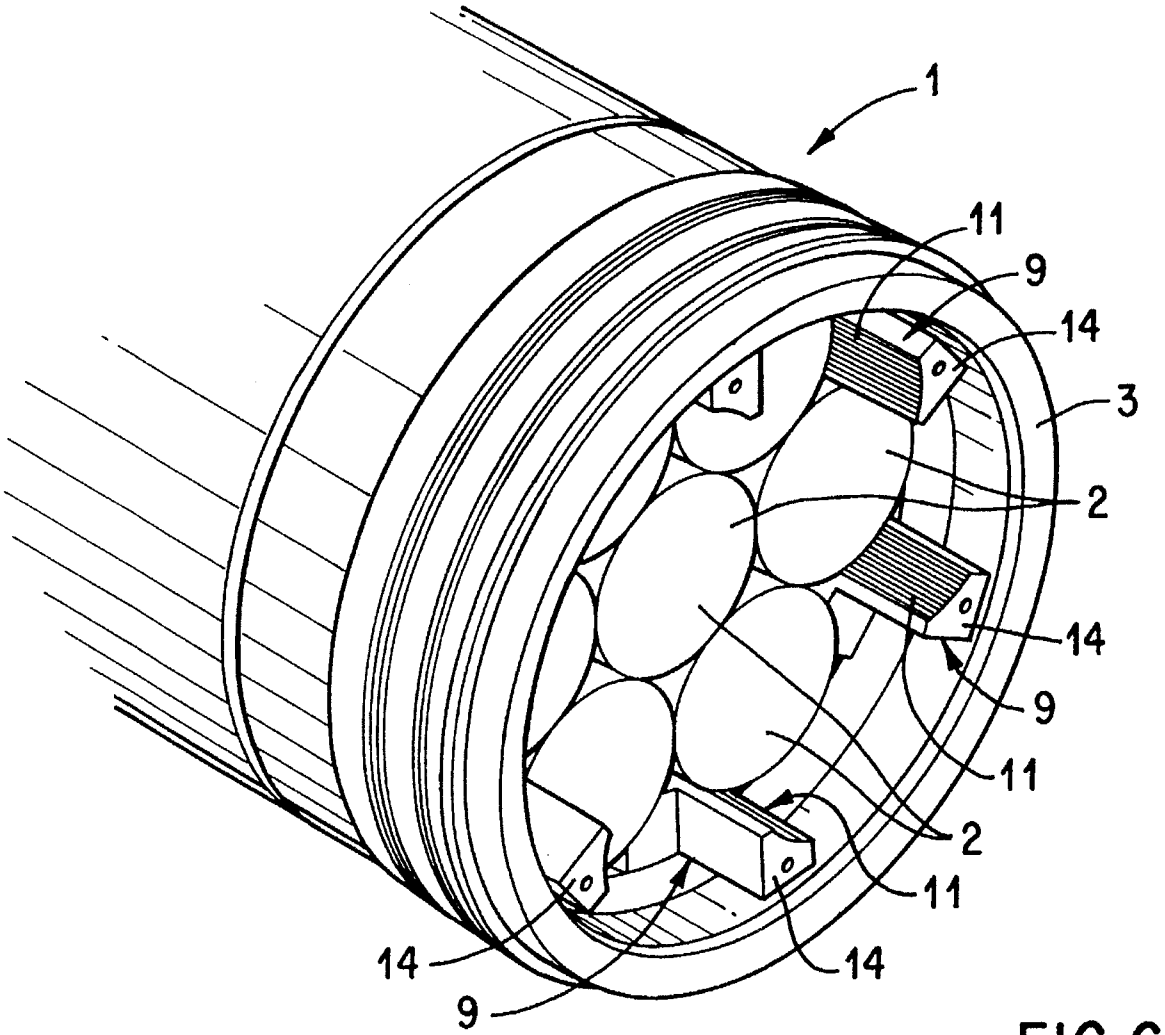
FIGS. 6*a* and 6*b* show the rear of a shell after the bomblets and bars have been installed.

FIG. 6*a* represents the rear of a cargo shell in which the bomblets 2 and the different wedging bars 9 in their "initial position" have been installed.

The cargo shell is thereafter placed under a pressing tool fitted with a circular plate designed to exert pressure on all the protruding parts of the bars 9 (on the ends 14 of each bar).

The bars are all forced into their "wedging position" at the same time.

Figure 6B:
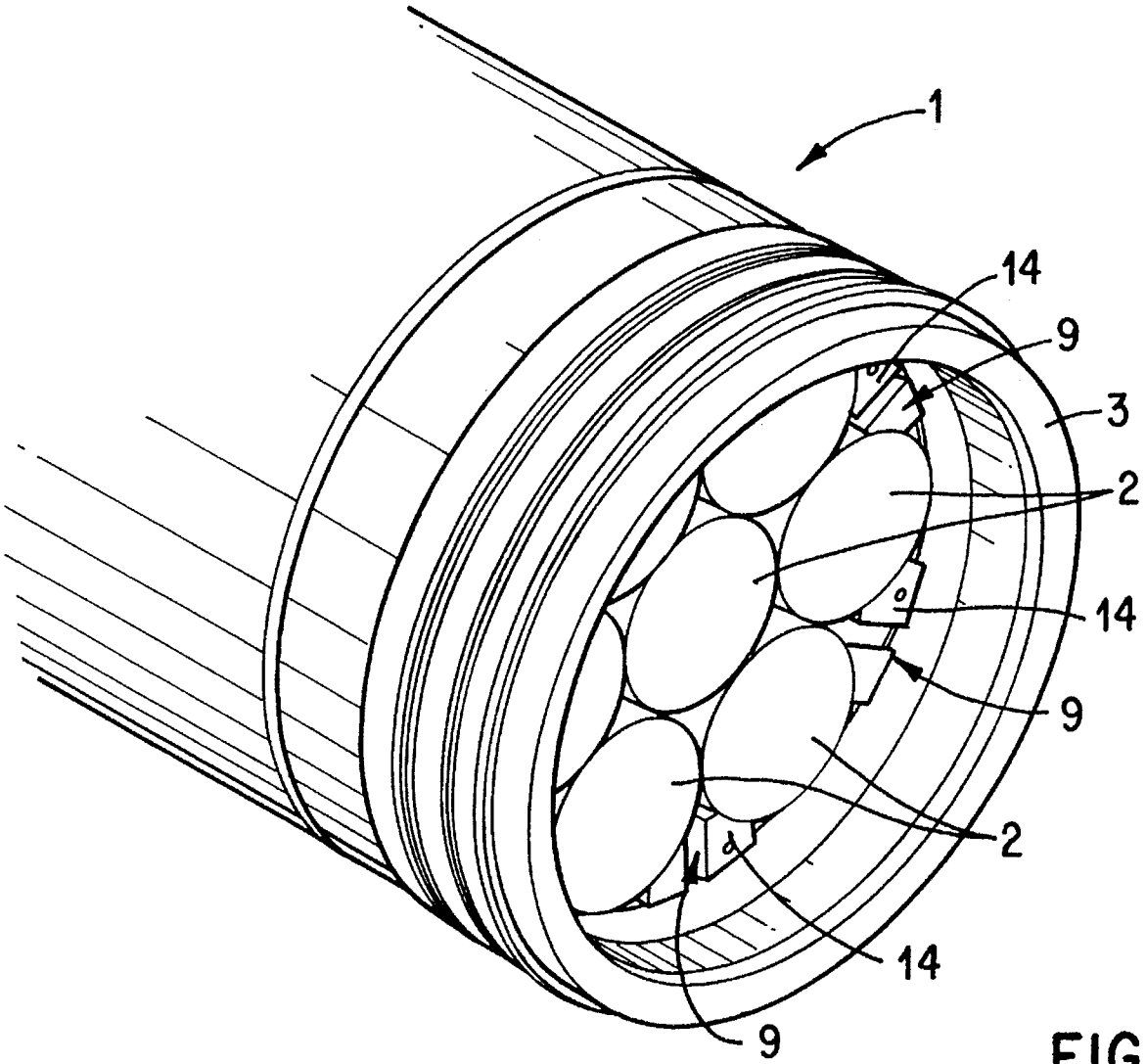

FIG. 6*b* represents the rear of a cargo shell in which the bomblets 2 and the different wedging bars 9 are in their "wedging position".

Thereafter, a circular wedging plate is positioned to ensure the axial wedging of the shell load followed by the closing base.

Only one compression operation is therefore needed to ensure the radial wedging of the load instead of six to nine operations for the wedging systems according to prior art.

As a variant, it is possible to envisage bars which are constituted of two half-bars, each half-bar being composed of a single block instead of an assembly of several block elements 12.

The device according to the invention has been described with application to the wedging of bomblets in an artillery cargo shell.

It is possible to use the wedging device according to the invention for any projectile designed to carry sub-munitions. This device could be used in particular for missile-type projectiles, rockets or mortar projectiles.

I claim:

1. A wedging device for sub-munitions placed inside an envelope of a projectile, said wedging device comprising:

a plurality of bars, each bar comprising a bearing surface engageable with an internal surface of an envelope and two holding surfaces engageable with at least two adjacent sub-munitions, wherein each bar is divided into at least two half-bars that contact with one another, each half-bar having at least one slanted guiding surface such that relative sliding between slanted guiding surfaces of adjacent half-bars enables the two holding surfaces to be forced apart thereby expanding a width of each bar and eliminating any radial give in the sub-munitions within the envelope.

2. A device according to claim 1, wherein each half-bar is constituted of the assembly of at least two identical block elements, each block element comprising a bearing surface, a holding surface and a guiding surface.

3. A device according to claim 2, wherein the block elements constituting a half-bar are fitted together with dog points and holes fitted on ends of the block elements.

4. A device according to claim 2, wherein the block elements are identical.

5. A device according to claim 4, wherein each block is fitted with a pin on a guiding surface, said pin being designed to fit into a housing fitted in the guiding surface of another block, the pins and housings enabling the two half-bars to be assembled in a relative position such that the distance between the holding surfaces of the bar is minimal.

6. A device according to claim 1, wherein the bars are made of a plastic material.

7. A device for wedging sub-munitions placed within an envelope of a projectile, comprising:

a bar assembly located between an internal surface of an envelope and two adjacent sub-munitions; and means for expanding a width of the bar assembly to tightly wedge the sub-munitions within the envelope, wherein the means for expanding includes slanted guiding surfaces of adjacent parts of said bar assembly, said slanted guiding surfaces being relatively slidable with respect to each other to expand the width of the bar assembly.

8. A method of wedging sub-munitions placed within a projectile envelope, the method comprising:

inserting a bar assembly between an internal surface of an envelope and two adjacent sub-munitions;

expanding a width of the bar assembly thereby tightly wedging the sub-munitions within the envelope; and wherein the expanding includes relatively sliding slanted guiding surfaces of adjacent parts of said bar assembly with respect to one another to expand the width of said bar assembly.

* * * * *